US006056440A

United States Patent [19]

Nattrass

[11] Patent Number: 6,056,440

[45] Date of Patent: May 2, 2000

[54] SIFT PROOFING MEMBRANE FOR BULK LIFT BAG AND METHOD

[76] Inventor: Peter J. Nattrass, 3 Auburn La., Barrington, Ill. 60010

[21] Appl. No.: 09/251,828

[22] Filed: Feb. 17, 1999

[51] Int. Cl.[7] ..... B65D 33/16; B65D 33/00

[52] U.S. Cl. ..... 383/109; 383/67; 383/105; 383/903

[58] Field of Search ..... 383/24, 41, 67, 383/105, 113, 111, 109, 903

[56] References Cited

U.S. PATENT DOCUMENTS

| | | | |
|---|---|---|---|
| 3,961,655 | 6/1976 | Nattrass et al. | 383/24 |
| 4,597,102 | 6/1986 | Nattrass | 383/105 |
| 4,628,535 | 12/1986 | Tetenborg | 383/24 |
| 4,646,357 | 2/1987 | Nattrass . | |
| 4,852,687 | 8/1989 | Hittler . | |
| 4,872,252 | 10/1989 | Hittler . | |
| 4,901,743 | 2/1990 | Hittler . | |
| 5,538,155 | 7/1996 | Hoekstra | 383/111 X |
| 5,553,933 | 9/1996 | Ross . | |
| 5,738,619 | 4/1998 | Nattrass . | |
| 5,762,421 | 6/1998 | Ross . | |
| 5,938,338 | 8/1999 | McDonough | 383/24 |

*Primary Examiner*—Jes F. Pascua
*Attorney, Agent, or Firm*—Mathew R. P. Perrone, Jr.

[57] ABSTRACT

A membrane having dimensions slightly larger than the dimensions of a bulk lift bag is inserted into the bag, so that the membrane may expand as the bag is filled without tearing. The membrane may be secured to the bag at a flange, without perforating the membrane.

20 Claims, 3 Drawing Sheets

SIFT PROOFING MEMBRANE FOR BULK LIFT BAG AND METHOD

This invention relates to a bulk lift bag and more particularly to bulk lift bag having a sift proof membrane liner, which suitably and accurately fits into the bulk lift bag, and permits very fine particles to be carried in the bulk lift bag without the fine particles sifting or otherwise migrating through seam stitch holes or open weave fabric in the bulk lift bag.

BACKGROUND OF THE INVENTION

Large fabric bags are commonly used for transporting bulk quantities of particulate material. Each bag is large and heavy enough to require lifting by mechanical equipment having hooks or tines. One example of such equipment is a forklift truck.

These advantages of large fabric bags for the carrying particulate material are clear. These bags are easily filled, stored, and transported. After the particulate material has been emptied from the bags, the bag can be folded for ease of storage and reuse. It is very critical that each bag be sufficiently strong to hold a substantial amount of material. It is common for such bags to hold in excess of 2,000 kilograms each.

The named inventor of this application is the inventor or coinventor of a number of other patents in this field. His experience in this field causes his company to be a highly recognized leader in the field of bulk material handling. These patents include, but are not limited to U.S. Pat. Nos. 5,738,619 and 4,646,357.

Typically, the bags are desired to be of uniform square, rectangular, or cylindrical horizontal cross-section. The circular cross-section is more efficient use of material, relative to volume of the container and the surface area of material used to form the container as a cylinder. Transport efficiency is more effective with the square cross section. This square efficiency is related to the shape of the transport or shipping containers, which transport containers are not cylindrical.

Generally, bags are required to be made of expensive, heavy-duty material to achieve desired strength for carrying the weight of material. The fabric used for these bags is required to have a weight of at least five ounces per square yard (150 grams per square meter) and a tensile strength of at least 220 pounds per square inch (28.2 kilograms per square centimeter). Such a strong fabric is required to make a bag of sufficient strength.

As of now, a bulk lift bag, formed from a woven fabric, requires that the fabric be coated, so the bag might hold fine particles. Coating is expensive, and often peels off and gets mixed with the product contained in the bag by the end users, especially a particulate product being removed from the resulting bag. Additionally the sewing, required to form the fabric into the bag, produces apertures in the fabric, which, in turn permits the powder or fine particle to flow through the apertures and out of the bag.

While the coated bag requires no liner, the sewing apertures and the stretching of the bag upon filling, storing, and transporting, cause sifting problems. The sewing process causes apertures in the lining and allows the powder to either cake, or flow out of the bag, through the sewing apertures.

Sometimes, a material, suitable for use as seat belts or other narrow strips of fabric, is placed in between the sewn sections of the bulk bag and secured therein. This structure, designed to avoid leaking of fine powders from the bulk bag, does not work, because the hole elongates when a filled bag is lifted. Fine powders can just pour out through the elongated holes.

Still a further problem, with addition of this strip of material to the seams, occurs as the manufacturing process slows to one-half of manufacturing speed. In other words, the addition of this thin strip of to the manufacturing process cuts production of bags per hour by about one-half. As a result, production costs greatly increase and create a problem.

There are many other problems with making sift proof bags to contain very fine particles of material. Typical bulk lift bags are usually woven from polypropylene. It is known to put a polyethylene bag formed from a film inside a polypropylene bag in order to keep the powder or other contents dry and contained within the bulk bag, but these methods are clumsy expensive, wasteful and unsuccessful.

This liner of the prior art must have a substantial, excess amount of material, in order to avoid the stretching and forcing the liner to tear, while the lined bag is being filled and transported. Because of this excess material, loading and unloading of the bulk lift bag can be made more complicated.

After the bag is filled, the excessively sized liner, which is about 150 inches tall (380 centimeters) in circumference, for the bag extends well over the top of the bag. The excess top portion is then tied. When emptying the bag, this liner causes a problem. As the bag is opened at the bottom, the liner slides down and clogs up the auger as it dispenses the powdered material from the bag.

The liner material can be torn and can get mixed with the material or particles being removed from the bag in the auger, resulting in damage, both to the auger and to the material carried in the bag. This is especially important when food or a specialty material is carried in the bag.

Clearly, the bulk lift bag is highly advantageous as a transport mode. The sifting problem is a major difficulty in transportation of fine particles. A simplified correction has yet to be found.

SUMMARY OF THE INVENTION

Among the many objectives of this invention is the provision of a membrane liner for a bulk lift bag designed to carry particles as bulk products.

Another objective of this invention is to provide a membrane liner for a bag to carry bulk products, which membrane liner remains stable after filling and without excess material at the top and bottom.

Yet another objective of this invention is to provide a membrane liner for a bag to carry bulk products, which membrane liner permits simplified emptying of the bag.

Still another objective of this invention is to provide a membrane liner for a bag to carry bulk products, which membrane liner may be ground into small particles and recycled and the outer bag reused after insertion of a new membrane liner.

Additionally, an objective of this invention is to provide a membrane liner for a bag to carry bulk products, which membrane liner avoids perforation when the bag is sewn.

A further objective of this invention is to provide a membrane liner for a bag to carry bulk products, which membrane liner avoids interference with the emptying of bag.

These and other objectives of the invention (which other objectives become clear by consideration of the specification, claims and drawings as a whole) are met by providing a membrane liner slightly larger than the dimensions of the bag so that the membrane liner may expand as the bag is filled without tearing.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
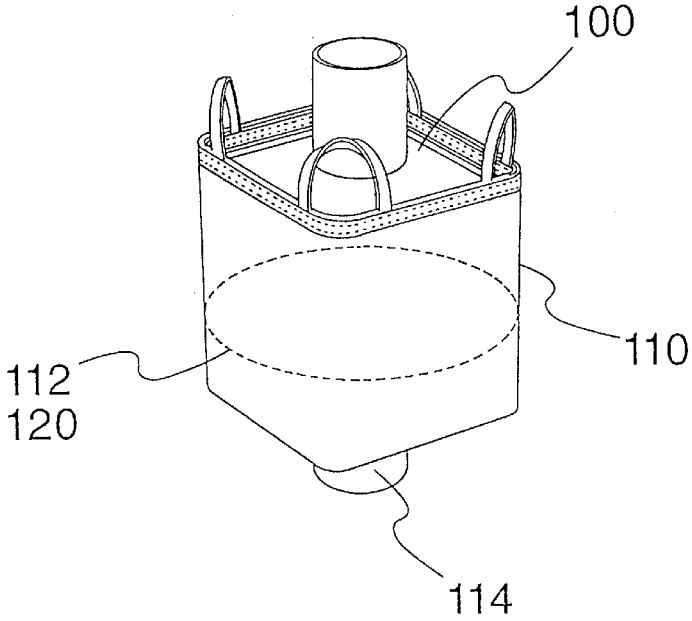
FIG. 1 depicts a top perspective view of the membrane liner 100 in bulk lift bag 110.

A membrane liner, which has slightly little larger dimensions than the bulk bag into which it is inserted, permits the bag to be lined efficiently. The bag can then hold fine particulate material very efficiently, avoid the fine particles sifting through the bag. The membrane liner has an outlet tube in the membrane liner. The outlet tube is shorter than the outlet on the bag, so that the outlet tube of the membrane liner does not hang below the discharge tub of the bag.

The membrane or liner shapes itself to fit the bag as or when the bag is filled. Membrane volume is up to about 110 percent of the bag volume. More preferably, membrane volume is about 100.1 percent to about 109 percent of the bag volume. Most preferably, membrane volume is about 100.3 percent to about 105 percent of the bag volume.

It is sometimes desirable to sew the membrane liner in place in a bulk lift bag without perforating the membrane liner. This avoidance of the perforations is accomplished by sewing the membrane liner to the bag only at the top thereof. Thus the lower part of membrane liner remains unperforated and avoids the sift through of the powdered product in the bag. The membrane liner containing bag is better than a coated fabric bag, because the bulk lift bag becomes reusable or recyclable. The bag may also be more produced more efficiently.

This polyethylene bag or membrane liner fitting inside a polypropylene bag has a larger diameter than the exterior perimeter of polypropylene bag. This avoids tearing of the membrane liner when the particulate material is loaded into or fills the lined bag for transportation.

The membrane liner has a seam or flange welded, glued or otherwise adhered on to it. The membrane liner is welded at the seam or flange to the shape of the bag and made appropriate. The bag can be hermetically sealed and cannot move due to the flange. Material for the bag may preferably be polyethylene or polypropylene.

A membrane liner may be inserted into a heavy duty bulk bag. This liner may include a top cover and a bottom support secured to a central section. The top cover may be a sheet, which is either a film or a woven fabric. This top cover is preferably formed either of polyethylene or of polypropylene. The inlet is secured to the top of the membrane liner preferably by a center portion by an and adhesive or a thermal weld. The membrane liner has a bottom sheet or bottom support secured to a center section. An outlet secured to the bottom support in any standard fashion, but preferably by an adhesive or a thermalweld process.

While thermal weld is discussed, any reasonable fusing or gluing process may be used. It is especially desired to eliminate any apertures in the membrane liner at the base area thereof.

The circumference of the membrane liner is about one centimeter to about ten centimeters larger than circumference the bag into which the membrane liner is being placed. More preferably, the circumference of the membrane liner is about two centimeters to about nine centimeters larger than circumference the bag into which the membrane liner is being placed. Most preferably, the circumference of the membrane liner is about three centimeters to about seven centimeters larger than circumference the bag into which the membrane liner is being placed.

In this fashion, the membrane liner can be placed in the bag more efficiently and avoids stress on the membrane liner or liner. This membrane liner makes the bag leak proof and in a less expensive fashion. This membrane liner also may be fitted into the bag without substantially slowing the is production of the outer bags. The membrane liner may be formed of material from about 0.25 millimeter (0.001 inch) to about 2.5 millimeters (0.010 inch) thick. More preferably, the membrane liner may be formed of material about 0.38 millimeter (0.0015) inch to about 1.0 millimeter (0.004 inch) thick. Most preferably, the membrane liner may be formed of material about 0.38 millimeter (0.0015 inch) to about 0.76 millimeter (0.003 inch) thick.

This membrane liner may be formed to fit into a square cross-sectioned bulk lift bag or circular cross-sectioned bulk lift bag. The membrane liner may be made of film material. This particular membrane stops the membrane interference with the use of the bulk lift bag, and avoids the slowing of production for bags that require membranes. The thermalweld of the membrane liner and the shape of the membrane permits the bags to be leak proof and permit the bag to more efficiently used carrying very fine powders. The particular size of the membrane liner in combination with the welds permit the membrane liner to be inserted in the bag efficiently and permit the formation of a leak proof bag with only minimal interference with production.

In FIG. 1, the membrane liner 100 fits into bulk lift bag 110. Membrane liner 100 has a membrane circumference 120, which is the same size or a little larger than the bag circumference 112. Thus membrane liner 100 can efficiently fit into bulk lift bag 110. The bulk lift bag 110 can then hold fine particulate material very efficiently.

Figure 2:
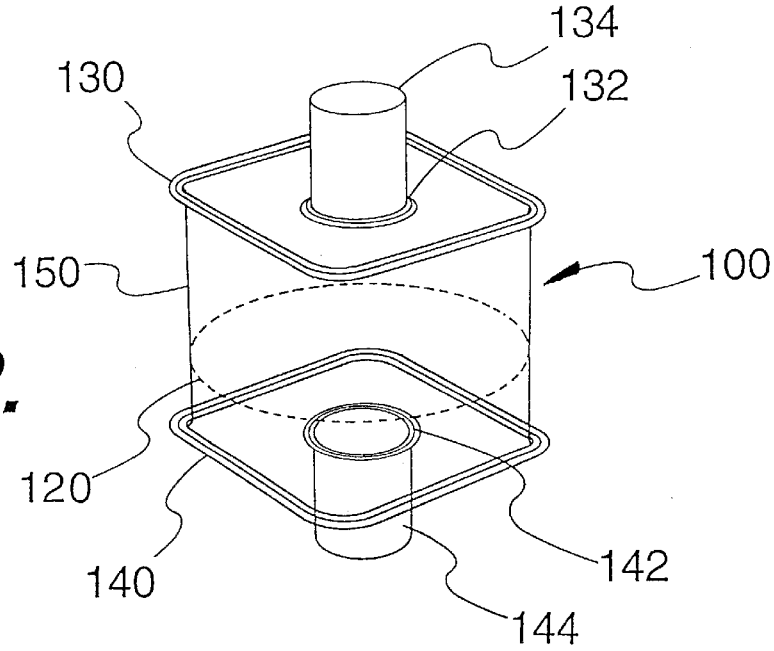
FIG. 2 depicts a top perspective view of the membrane liner 100.

Adding FIG. 2 to the consideration, membrane liner 100 has a top cover 130 and a bottom support 140 secured to a central section 150. The top cover 130 has an inlet 132. Inlet 132 has a receiving tube 134 secured thereto, preferably at a center portion by a thermal weld. Top cover 130 is preferably square in shape, although other shapes are operable.

The membrane liner 100 has a bottom sheet or bottom support 140 secured thereto at a bottom portion of central section 150. An outlet 142 is secured to the bottom support 140 in any standard fashion, but preferably by a thermalweld process. The membrane liner 100 has an outlet tube 144 in the bottom support 140. The outlet tube 144 is shorter than the bag outlet 114 on the bag 110, so that the outlet tube 144 of the membrane liner 100 does not block the bag outlet 114.

Figure 3:
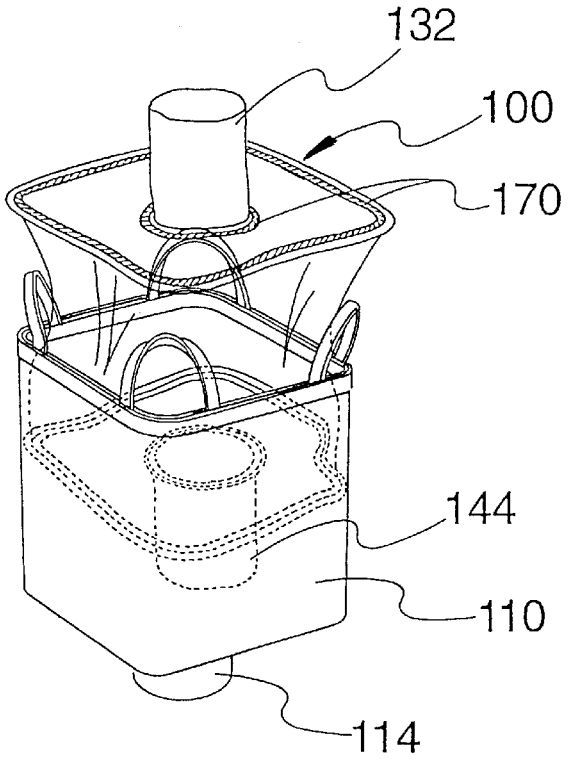
FIG. 3 depicts a top, partially exploded, perspective view of the membrane liner 100 and bulk lift bag 110.

Adding FIG. 3 to the consideration, the bulk lift bag 110 receives the membrane liner 100. Because the dimensions and thus the volume of the membrane liner 100 are slightly larger than the dimensions of the bulk lift bag 110, the membrane liner 100 fits efficiently therein.

Figure 4:
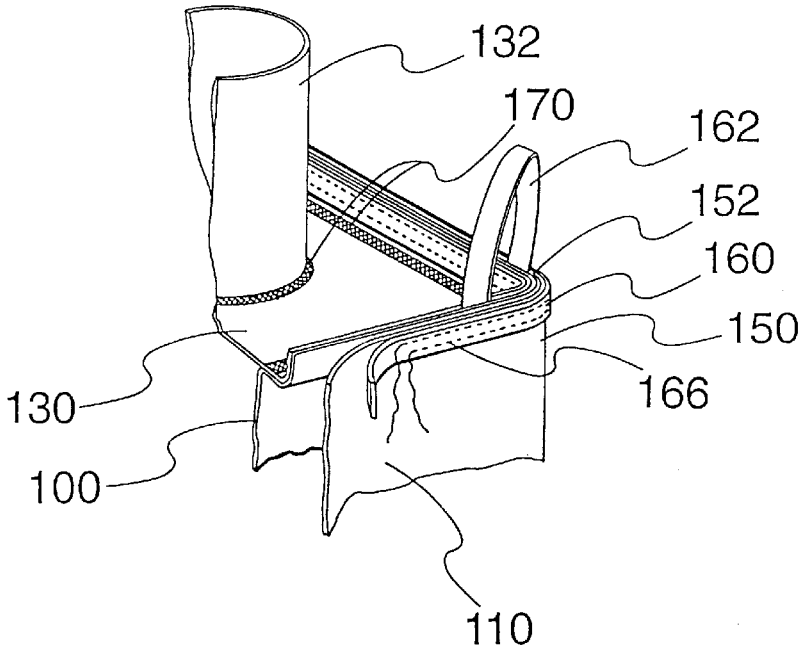
FIG. 4 depicts a top, perspective view of the membrane liner 100 and bulk lift bag 110, shown in a partially cutaway view.

With the consideration of FIG. 4, the structure of membrane liner 100 becomes more clear. The membrane liner 100 has a seam or flange 152 welded to the center section 150. To flange 152, top 140 may be thermalwelded or otherwise secured, thereby securing the top 140 to central portion 150. The shape of top 140 determines the cross-section of central portion 150 and the shape of bag 110, which may receive the membrane liner 100.

An optional outboard safety band 160 around the outside top edge of the bulk lift bag 110 supports the lift loop strap 162 in the attachment to the bag 110. An easily removable chain stitch 166 provides additional security. The bag structure for bulk lift bag 110 is more clearly set forth in the cited patents by the same inventor.

Figure 5:
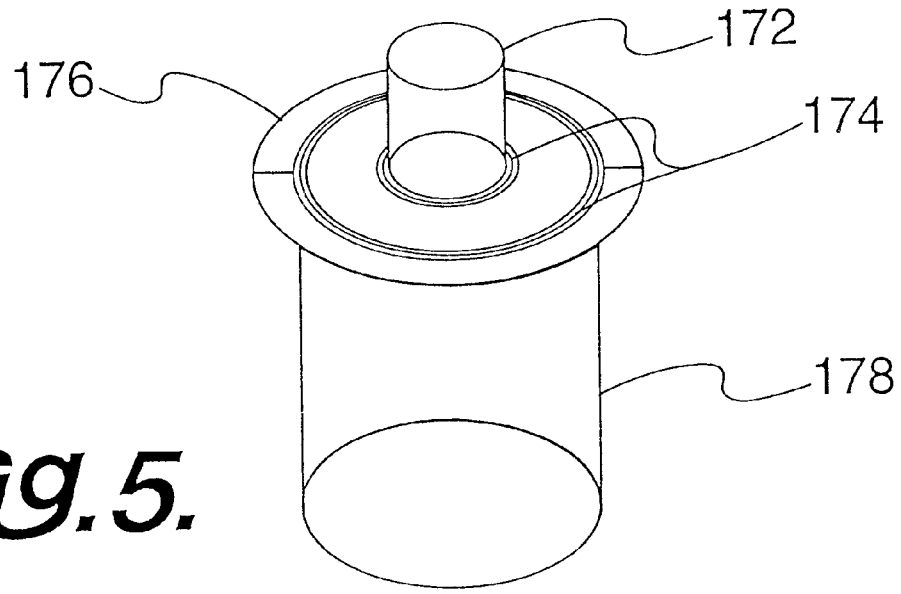
FIG. 5 depicts a top, perspective view of the membrane liner 100 with flange 176.

Referring now to FIG. 5, top cover 130 of liner 100 includes a top chute 172 above the weld 174 or securing point of top cover 130 at a top of chute base 178. Chute base 178 replaces center section 150 and bottom support 140 of FIG. 2, but is interchangeable therewith. Weld 174 also secures chute flange 176 to chute base 178. Thus, weld 174 is used to secure the liner 100 to bulk lift bag 110. With sewing of flange 176, no apertures appear in the liner 100 due to the sewing step.

Figure 6:
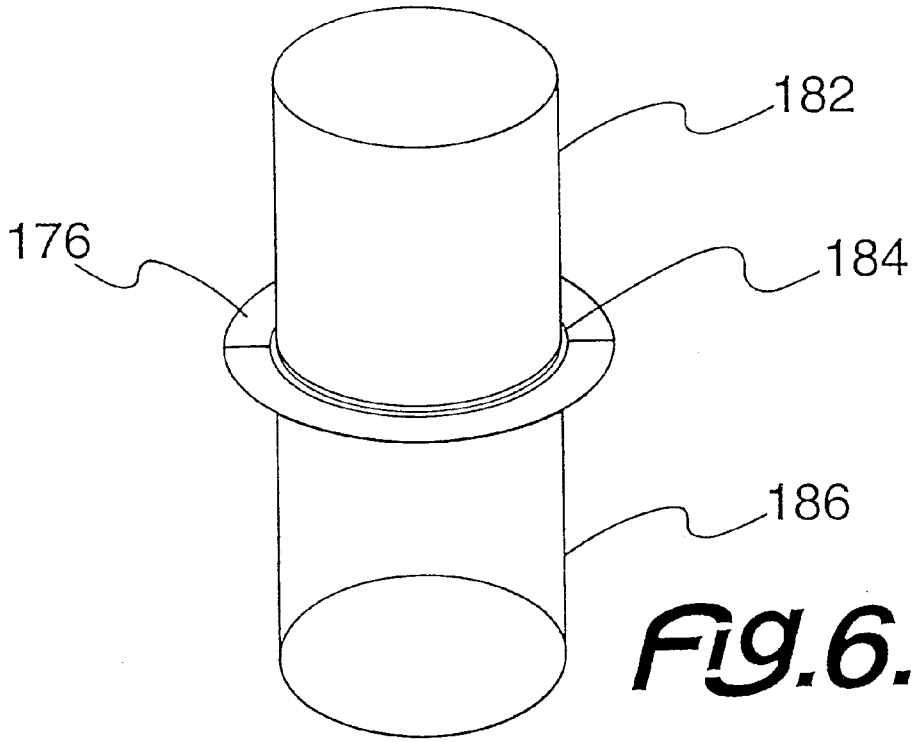
FIG. 6 depicts a top, perspective view of the membrane liner 100 with skirt 182.

Referring now to FIG. 6, an optional skirt 182, as a replacement for top cover 130, may be secured to central skirt section 186, in order to form the membrane liner 100. Also, like chute base 178 of FIG. 5, central skirt section 186 replaces center section 150 and bottom support 140 of FIG. 2, but is interchangeable therewith. This skirt 182 is thus positioned at a top edge of the central skirt section 186 for the purpose of replacing top cover 130. Securing is accomplished by thermalwelding or similar methods described herein. Flange 176 is also reproduced thereby for the same purpose as in FIG. 5.

This application—taken as a whole with the abstract, specification, claims, and drawings being combined—provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by letters patent of the united states is:

1. A sift-proof, bulk lift bag assembly comprising a bulk lift bag and a membrane liner being within the bulk lift bag, the membrane liner having a membrane volume 100.1 percent to 109 percent of a bag volume of the bulk lift bag, in order that the membrane may expand against the bulk lift bag as the bulk lift bag is filled, thereby avoiding a rupture of the membrane liner and sealing the bag against the sifting through of contents in the bag.

2. The sift-proof, bulk lift bag assembly of claim 1 further comprising:

(a) the bulk lift bag having a top bag portion and a bottom bag portion;

(b) the top bag portion being oppositely disposed from the bottom bag portion;

(c) the membrane liner having a top membrane portion and a bottom membrane portion; and (b) the top membrane portion being oppositely disposed from the bottom portion.

3. The sift-proof, bulk lift bag assembly of claim 2 further comprising:

(a) the top membrane portion being positioned adjacent to the top bag portion; and (b) the membrane volume being about 100.1 percent to about 109 percent of the bag volume.

4. The sift-proof, bulk lift bag assembly of claim 3 further comprising:

(a) the top membrane portion being secured to the top bag portion; and (b) the membrane volume being about 100.3 percent to about 105 percent of the bag volume.

5. The sift-proof, bulk lift bag assembly of claim 1 further comprising:

(a) the membrane liner having a membrane outlet tube in a bottom membrane portion of the membrane liner;

(b) the bulk lift bag having a bag outlet tube in a bottom bag portion of the bulk lift bag; and (c) the membrane outlet tube being contained within the bag outlet tube.

6. The sift-proof, bulk lift bag assembly of claim 5 further comprising:

(a) a holding means for securing a top membrane to a top bag portion of the membrane liner; and (b) the membrane having a flange secured thereto at the top membrane portion.

7. The sift-proof, bulk lift bag assembly of claim 6 further comprising:

(a) the flange securing the membrane liner to the bulk lift bag in order to adapt the membrane liner to the shape of the bulk lift bag; and (b) the membrane volume avoiding stress on the membrane liner, as the bulk lift bag is filled.

8. The sift-proof, bulk lift bag assembly of claim 7 further comprising:

(a) the membrane liner serving to make the bulk lift bag leak proof;

(b) the membrane liner being about 0.25 millimeter to about 2.5 millimeters thick;

(c) a top cover for the membrane liner being secured thereto; and (d) the top cover determining a liner shape for the membrane liner to substantially match a bag shape for the bulk lift bag.

9. The sift-proof, bulk lift bag assembly of claim 8 further comprising:

(a) the membrane liner having a center portion, a top cover, and a bottom sheet;

(b) the top cover being secured to the center portion at a top thereof; and (c) the bottom sheet being secured to the center portion at a bottom thereof.

10. The sift-proof, bulk lift bag assembly of claim 9 further comprising:

(a) a flange being secured to the center portion; and (b) the flange reinforcing the top cover as secured to the center portion.

11. The sift-proof, bulk lift bag assembly of claim 10 further comprising the membrane liner being formed of material about 0.38 millimeter to about 0.76 millimeter thick.

12. A sift-proof, bulk lift bag assembly comprising (a) a bulk lift bag and a membrane liner being within the bulk lift bag;

(b) the membrane liner having a membrane volume up to ten percent larger than a bag volume of the bulk lift bag, in order that the membrane may expand against the bulk lift bag as the bulk lift bag is filled, in order to avoid tearing of the membrane liner and to provide sealing the bag against the sifting through of contents in the bag;

(c) the bulk lift bag having a top bag portion and a bottom bag portion;

(d) the top bag portion being oppositely disposed from the bottom bag portion;

(e) the membrane liner having a top membrane portion and a bottom membrane portion;

(f) the top membrane portion being oppositely disposed from the bottom portion;

(g) the top membrane portion being positioned adjacent to the top bag portion;

(h) the membrane volume being about 100.3 percent to about 105 percent of the bag volume; and (i) the top membrane portion being secured to the top bag portion.

13. The sift-proof, bulk lift bag assembly of claim 12 further comprising:

(a) the membrane liner having a membrane outlet tube in the bottom membrane portion;

(b) the bulk lift bag having a bag outlet tube in the bottom bag portion;

(c) the membrane cutlet tube being contained within the bag outlet tube; and (d) a holding means tor securing the top membrane to the top bag portion.

14. The shift-proof, bulk lift bag assembly of claim 13 further comprising:

(a) the holding means for securing the top membrane to the top bag portion being a sewing operation;

(b) the membrane having a flange secured thereto at the top membrane portion;

(c) the flange securing the membrane liner to the bulk lift bag in order to adapt the membrane liner to the shape of the bulk lift bag; and (d) the membrane volume avoiding stress on the membrane liner, as the bulk lift bag is filled.

15. The sift-proof, bulk lift bag assembly of claim 14 further comprising:

(a) the membrane liner serving to make the bulk lift bag leak proof;

(b) the membrane liner being about 0.25 millimeter to about 2.5 millimeters thick;

(c) a top cover for the membrane liner being secured thereto; and (d) the top cover determining a liner shape for the membrane liner to substantially match a bag shape for the bulk lift bag.

16. The sift-proof, bulk lift bag assembly of claim 15 further comprising:

(a) the membrane liner having a center portion, a top cover, and a bottom sheet;

(b) the top cover being secured to the center portion at a top thereof; and (c) the bottom sheet being secured to the center portion at a bottom thereof.

17. The sift-proof, bulk lift bag assembly of claim 16 further comprising:

(a) a flange being secured to the center portion; and (b) the flange reinforcing the top cover as secured to the center.

18. The sift-proof, bulk lift by assembly of claim 17 further comprising the membrane liner being formed of material about 0.38 millimeter to about 0.76 millimeter thick.

19. A method for forming a shift proof bulk lift bag assembly comprising:

(a) providing a bulk lift bag having a top bag edge and a bottom bag edge, the bottom bag edge being oppositely disposed from the top bag edge;

(b) providing a membrane liner having a top liner edge and a bottom liner edge to fit within the bulk lift bag, the membrane liner, having a membrane volume 100.3 percent to 105 percent larger than a bag volume of the bulk lift bag, thereby allowing the membrane liner to expand without tearing or having excess material in the bag; and (c) securing the top liner edge to the top bag edge.

20. The method of claim 19 further comprising:

(a) providing the membrane liner with a membrane outlet tube centrally situated relative to the bottom liner edge, (b) providing the bulk lift bag with having a bag outlet tube centrally situated relative to the bottom bag edge; and (c) having the membrane outlet tube being contained within the bag outlet tube.

* * * * *